United States Patent [19]

Theurer et al.

[11] Patent Number: 4,703,568

[45] Date of Patent: Nov. 3, 1987

[54] MOBILE TRACK WORKING MACHINE OPERATOR CAB ARRANGEMENT

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[21] Appl. No.: 800,358

[22] Filed: Nov. 21, 1985

Related U.S. Application Data

[63] Continuation of Ser. No. 491,028, May 3, 1983, abandoned.

[30] Foreign Application Priority Data

Aug. 24, 1982 [AT] Austria ..... 3201/82

[51] Int. Cl.[4] ..... E01B 29/02

[52] U.S. Cl. ..... 37/104; 104/2; 104/12; 105/456

[58] Field of Search ..... 104/2, 12, 279; 105/456; 296/64, 65 R, 156, 164; 37/104–107

[56] References Cited

U.S. PATENT DOCUMENTS

| | | | |
|---|---|---|---|
| 3,088,537 | 5/1963 | Tourneau | 296/65 R X |
| 3,182,605 | 5/1965 | Brasher | 105/456 X |
| 3,521,722 | 7/1970 | Dimonte | 296/65 R X |
| 3,841,429 | 10/1974 | Falcone et al. | 296/65 R X |
| 4,026,379 | 5/1977 | Dunn et al. | 105/456 X |
| 4,059,171 | 11/1977 | Pakosh | 296/65 R X |
| 4,155,309 | 5/1979 | Ames et al. | 105/456 |
| 4,184,434 | 1/1980 | Chapin | 105/456 |
| 4,227,324 | 10/1980 | Theurer | 104/279 X |
| 4,331,082 | 5/1982 | Pasquini | 104/12 |
| 4,342,263 | 8/1982 | Hurni | 104/7 B |

FOREIGN PATENT DOCUMENTS

| | | | |
|---|---|---|---|
| 322608 | 5/1975 | Austria . | |
| 1008211 | 5/1952 | France | 105/456 |
| 0171930 | 9/1934 | Switzerland | 105/456 |

*Primary Examiner*—Randolph A. Reese
*Assistant Examiner*—Edward M. Wacyra
*Attorney, Agent, or Firm*—Kurt Kelman

[57] ABSTRACT

A track working machine comprising a frame mounted for mobility on the track, an operating unit mounted on the frame, the operating unit including tools for working on the track and a drive for moving the machine along the track in an operating direction, and an operator's stand including a seat for the operator and a control panel and actuating element for the drive associated with the seat for operation by the operator, the operator's stand with the seat and drive actuating element being pivotal about a vertical axis between two end positions in the operating direction and in a direction opposite to the operating direction, respectively, in relation to the frame and the operating unit, and being blocked in each one of the end positions.

4 Claims, 3 Drawing Figures

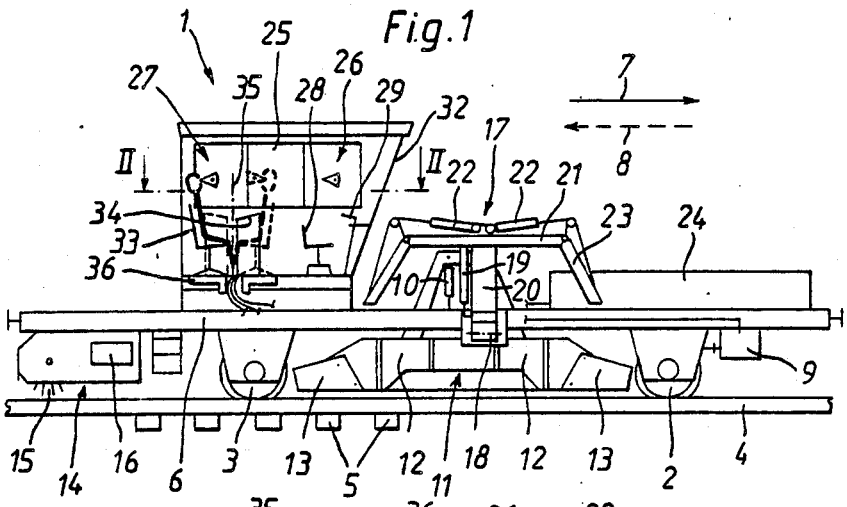
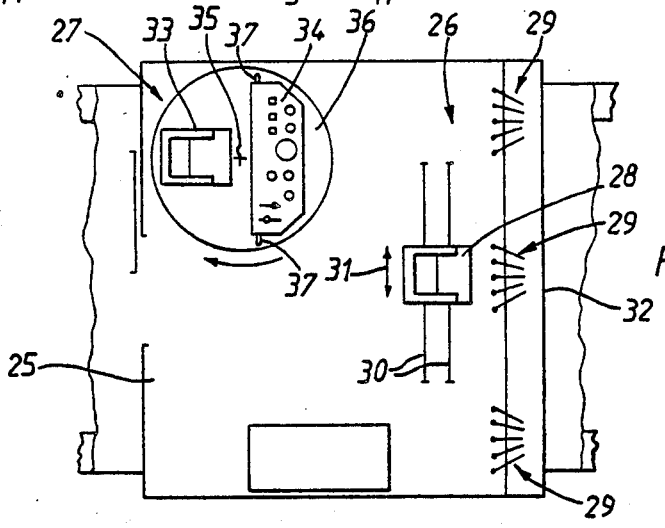
Fig.2
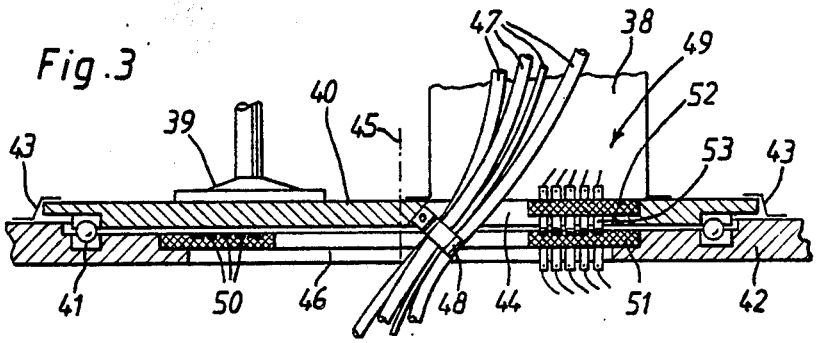

MOBILE TRACK WORKING MACHINE OPERATOR CAB ARRANGEMENT

This is a continuation of our copending application Ser. No. 491,028, filed May 3, 1983, now abandoned.

The present invention relates to a track working machine comprising a frame mounted for mobility on the track, an operating unit mounted on the frame, the operating unit including tools for working on the track and drive means for actuating the tools, a drive for moving the machine along the track in an operating direction, and an operator's stand including a seat for the operator and a control panel and actuating means for the drive associated with the seat for operation by the operator.

Modern track working machines are usually equipped with an operator's stand arranged within a closed operator's cab which has observation windows all around its periphery so that the operating unit or units normally arranged on the machine frame forwardly of the cab in the operating direction are in the line of vision of the operator who may thus observe the track site where the tools work and the track section ahead of the machine. Depending on the type and equipment of the track working machine, the operator's stand has a control panel with various indicating and control instruments used in the work as well as actuating means for the machine drive as well as the tool drives.

Conventionally, track maintenance or rehabilitation machines as well as track working machines generally, including such machines with mounted cranes and the like, are equipped with usually separate, reversible drives for moving the machine in either direction. When such a machine has only one such frontwardly directed operator's stand as hereinabove described, difficulties are encountered when the machine is driven in reverse, for example to repeat an unsatisfactory track work operation or to return the machine to a rearwardly located yard, because the operator must turn around in his seat to be able to observe the track section behind him. Therefore, track working machines, for example ballast plows or ballast planing machines, have been equipped with an auxiliary operator's stand comprised of a control panel extending along a side wall of the cab, with actuating means for the machine drive, and an operator's seat facing the control panel. Depending on the direction of movement of the machine, the operator must, therefore, turn left or right to be able to observe the track section ahead of him. This body position is uncomfortable and tiring, which is aggravated by the fact that the actuating means at the control panel are in different positions with respect to the operator's grip, depending on the direction of forward movement of the machine. For this reason, the operator's cab of some such machines has been equipped with two like operator's stand at opposite sides of the cab and turned 180° with respect to each other. This provides favorable working and sighting conditions but is rather expensive because all structures are doubled.

U.S. Pat. Nos. 4,331,082, dated May 25, 1982, and 4,342,263, dated Aug. 3, 1982, disclose mobile track tampers equipped with an operator's cab in front on the tamping, leveling and lining units and a further operator's stand at the front end of the machine. This arrangement has the considerable disadvantage that the operator of the track tamping, lifting and lining tools must sit with his back turned in the operating direction of the machine so that he is subjected to a considerable physical trauma each time the machine is stopped as it advances stepwise from one tamping point to the next tamping point. In addition, of course, the operator has no view at all of the track ahead of the machine.

Austrian patent No. 322,608, of Aug. 15, 1974, discloses a mobile machine with a frame mounted for mobility on a track and carrying a boom with an excavating bucket for removing ballast from the track bed. The boom is mounted on a platform pivotal about a vertical axis and an operator's stand is carried by the pivotal platform in a conventional manner so that the operator may move with the boom and may thus be able to observe the work. Such a machine is not comparable to the type of machine herein described and the arrangement disclosed in the Austrian patent can, therefore, suggest nothing to solve the problem hereinabove set forth. In the machine of this invention, the operating unit is mounted on the machine frame and the operator's stand is pivoted in relation to the frame and the operating unit, this stand including a control panel and actuating means for the machine moving drive. In this manner, the invention solves the problems described hereinabove and not encountered in the machine of the Austrian patent.

It is the primary object of the present invention to improve a track working machine of the first-described type with as little expense as possible to enable the operator to observe the work with equal ease and comfort in either drive direction of the machine.

The above and other objects are accomplished in such a machine according to this invention with means for pivoting the operator's stand with the seat and drive actuating means about a vertical axis between two end positions in the operating direction and in a direction opposite to the operating direction, respectively, in relation to the frame and the operating unit, and means for blocking the operator's stand in each one of the end positions.

Compared to the known machines of this type wherein two separate operator's stands are arranged at the sides of the operator's cab for use in a respective operating direction of the machine, this very simple arrangement of the invention provides a considerable reduction in costs because only one structural unit is involved and this is simply adjusted for the respective operating directions of the machine. In addition, additional space is available in the operator's cab and the operating personnel, therefore, has more room for movement. Most importantly, the operator encounters the same operating and work observation conditions on the stand in either operating direction and the actuating means and indicating instruments may, therefore, be arranged on the operator's stand strictly according to ergonomic requirements.

The arrangement of the present invention is applicable to many track maintenance or rehabilitation or other track working machines equipped with a single operator's cab from which the drives for the movement of the machine along the track and for the operating tools of the machine are actuated and controlled. It may also be retrofitted on existing machines at relatively little cost.

The above and other objects, advantages and features of the invention will become more apparent from the following detailed description of a now preferred embodiment, taken in conjunction with the accompanying schematic drawing wherein FIG. 1 shows a side elevational view of a ballast planing machine according to the present invention;

FIG. 2 is an enlarged top view of the operator's cab of the machine along line II—II of FIG. 1; and FIG. 3 is an enlarged fragmentary section of a preferred embodiment of the pivotal operator's stand.

Referring now to the drawing and first to FIG. 1, there is shown track working machine 1 comprising frame 6 mounted on undercarriages 2, 3 for mobility on a track comprised of rails 4 and ties 5. The machine is equipped with drive 9 connected to the wheels of undercarriage 2 for moving the machine along the track in an operating direction, the drive being reversible to enable the machine to move in either direction, as indicated by arrows 7 and 8. An operating unit is mounted on frame 6 between the undercarriages and this operating unit includes tools for working on the track and drive means for actuating the tools. In the illustrated ballast planing machine, this unit includes central ballast plow arrangement 11 vertically adjustably mounted on the frame by drive means 10, such as a hydraulic jack. This arrangement is generally conventional and has, therefore, not been further described herein. It includes pivotal central plowshares 12 and side plowshares 13. With such a known plow arrangement, ballast may be moved in either direction over rails 4 between the center and the shoulders of the track bed or between the track bed shoulders, either when machine 1 is advanced in main operating direction 7 or, in reverse, in operating direction 8. Broom arrangement 14 with vertically adjustable rotary broom 15 is mounted at the rear end of machine frame 6 for sweeping ballast off the rails and to direct such excess ballast to chute arrangement 16 whose lateral outlets deposit such ballast on the track shoulders.

The operating unit further includes shoulder plow arrangement 17 comprising laterally projecting arm 20 pivotal by drive means 18, such as a hydraulic jack, about horizontal axis 18 extending in the direction of the longitudinal extension of machine 1, the outer end of arm 20 carrying plowshare 21 to whose ends plowshares 23 are hinged for pivoting by drive means 22, for example hydraulic jacks. Plow arrangement 17 may be used for shaping the track bed shoulder.

All of the above structures are conventional and their operations are well known to those skilled in the art. As is also conventional, machine 1 is equipped with operator's cab 25 and power plant 24 including a drive motor, current generator and hydraulic fluid and compressed air sources enclosed in a housing. To provide a better view, the side wall of operator's cab 25 facing the viewer in FIG. 1 has been omitted in this figure.

In the illustrated embodiment, the operator's cab contains two operator's stands 26 and 27. According to the invention, operator's stand 27 including seat 33 for the operator and control panel 34 and actuating means for drive 9 associated with the seat for operation by the operator is pivotal with the seat and drive actuating means about vertical axis 35 between two end positions in the operating direction 7 and in a direction 8 opposite to the operating direction, respectively, in relation to frame 6 and the operating unit. The illustrated embodiment comprises turntable 36 rotatable through about 180° between the two end positions and operator's stand 27 is arranged on the turntable. Operating handles 37 are mounted on both sides of panel 34 for enabling the operator to rotate the turntable and to block the stand in each one of the end positions. As indicated in FIG. 1 in full and broken lines, respectively, and by the symbolically shown eyes, the operator on stand 27 has a full view of the track section in front of machine 1 in either end position. The rotatable mounting of turntable 36 and the required connecting means between the actuating means on control panel 34, drive 9 and power plant 24 are illustrated only schematically in FIG. 1.

As best shown in FIG. 2, operator's cab 25 contains further operator's stand 26, which is generally conventional and includes seat 28 and actuating means 29, such as pivotal levers, for the tool drive means, such as jacks 10, 19 and 22. Further operator's stand 26 is arranged on frame 6 transversely centered and in a line of vision of the operator on seat 28 to the operating unit, and pivotal operator's stand 27 is arranged laterally displaced from, and preferably elevated in relation to, further operator's stand 26. In the illustrated embodiment, seat 28 of further operator's stand 26 may be transversely displaced in the directions indicated by double-headed arrow 31 along guide rails 30 to enable the operator readily to reach actuating means 29 distributed along front wall 32 of cab 25. In this manner, as will be appreciated from FIG. 1, the operator on stand 26 has a full view of the entire operating range of ballast plow arrangements 11 and 17 constituting the operating unit of machine 1 through glass wall 32 of operator's cab 25.

This arrangement is of particular advantage in the illustrated mobile ballast plow wherein the many actuating levers for the adjustment drives of the various plowshares are arranged along the entire width of the cab's front wall for operation by one operator while the driver of the plow is seated in the pivotal operator's stand. The laterally displaced and preferably elevated disposition of the pivotal stand affords the driver of the machine an excellent view in both operating directions of the machine because the forward view of the driver is not blocked by the operator of the machine tools, i.e. the plow means.

FIG. 3 shows a preferred embodiment of the pivotal operator's stand of this invention. The operator's cab has floor 42 fixedly mounted on the machine frame and roller bearing 41 mounts turntable 40 on the floor of the operator's cab for rotation about vertical axis 45. The operator's stand including seat 39 for the operator and control panel 38 is arranged on turntable 40 and the turntable defines bore 44 adjacent vertical axis 45. Clamps 43 engage the periphery of the turntable to prevent the same from being lifted off cab floor 42. Eccentric bore 44 in the turntable is in communication with underlying concentric bore 46 in floor 42 and flexible connecting means 47 constituted by hydraulic fluid hoses pass through bores 44, 46 to connect the actuating means on control panel 38 to corresponding drives. Clamp 48 attaches the bundle of connecting hoses to the turntable. Electrical actuating means and indicating instruments on control panel 38 are connected to an electric current source in power plant 24 by means of slip ring arrangement 49 comprised of contact ring 51 of insulating material mounted on floor 42 and defining a plurality of annular contact paths 50 and connecting part 52 mounted on turntable 40, sliding contacts 53 being arranged on the connecting part and yieldingly engaging contact paths 50.

This preferred embodiment of the pivotal operator's stand constitutes a structurally very simple assembly unit which may be readily retrofitted on existing machines. The flexible connecting means, such as hoses, cables and the like, assures a ready connection between the actuating means on the pivotal stand and the drives on the machine frame because the pivoting range does not exceed 180°. Mounting the turntable on an annular rolling bearing without a axial pivot bearing makes it possible to pass the flexible connecting means through the center of the turntable so that the flexible connecting means will not be appreciably deformed when the operator's stand is pivoted. Furthermore, the arrangement assures an easy pivoting of the stand so that no special pivoting drive is needed and the stand may be rotated manually.

What is claimed is:

1. A machine for planing ballast supporting a track, comprising (a) a frame mounted for mobility on the track, (b) a drive for moving the frame along the track in an operating direction, (c) an operating unit mounted on the frame, the operating unit including (1) ballast plow means for planing the ballast and (2) drive means for actuating the ballast plow means, (d) an operator's cab arranged on the frame, (e) a first operator's stand in the operator's cab and including (1) a seat for an operator, (2) a control panel and actuating means for the moving drive associated with the seat for operation by the operator, (3) the first operator's stand with the seat and moving drive actuating means being freely manually pivotal about a vertical axis through about 180° between two end positions facing respectively in the operating direction and in a direction opposite to the operating direction, in relation to the frame and the operating unit, and (4) means for blocking the freely pivotal first operator's stand in each one of the end positions, and (f) a second operator's stand in the operator's cab and including actuating means for the tool drive means, the second operator's stand being arranged transversely centered within viewing range of the operating unit and transversely displaceable, and the first operator's stand being arranged laterally displaced from the second operator's stand.

2. In the ballast planing machine of claim 1, a turntable freely rotatable through about 180° between the two end positions, the first operator's stand being arranged on the turntable, and flexible connecting means between the actuating means on the first operator's stand and the moving drive.

3. In the ballast planing machine of claim 2, an operator's cab having a floor fixedly mounted on the frame, a roller bearing mounting the turntable on the floor of the operator's cab for free rotation about the vertical axis, and the turntable defining a bore adjacent the vertical axis, the flexible connecting means passing through the bore in the turntable.

4. In the ballast planing machine of claim 1, the first operator's stand being elevated in relation to the second operator's stand.

* * * * *